US009340855B2

(12) United States Patent
Schade et al.

(10) Patent No.: US 9,340,855 B2
(45) Date of Patent: May 17, 2016

(54) VANADIUM-CONTAINING POWDER METALLURGICAL POWDERS AND METHODS OF THEIR USE

(75) Inventors: Christopher T. Schade, Marlton, NJ (US); Bruce Lindsley, Cinnaminson, NJ (US); Thomas Murphy, Philadelphia, PA (US); Wing-Hong Chen, Maple Shade, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 1030 days.

(21) Appl. No.: 13/433,408

(22) Filed: Mar. 29, 2012

(65) Prior Publication Data

US 2012/0255398 A1 Oct. 11, 2012

Related U.S. Application Data

(60) Provisional application No. 61/472,262, filed on Apr. 6, 2011.

(51) Int. Cl.

| | |
|---|---|
| ***C22C 33/02*** | (2006.01) |
| ***C22C 38/12*** | (2006.01) |
| ***C22C 27/02*** | (2006.01) |
| ***C22C 38/02*** | (2006.01) |
| ***C22C 38/04*** | (2006.01) |
| ***C22C 38/08*** | (2006.01) |
| ***C22C 38/16*** | (2006.01) |

(52) U.S. Cl.

CPC ..... *C22C 33/0207* (2013.01); *C22C 27/02* (2013.01); *C22C 33/0278* (2013.01); *C22C 38/02* (2013.01); *C22C 38/04* (2013.01); *C22C 38/08* (2013.01); *C22C 38/12* (2013.01); *C22C 38/16* (2013.01); *B22F 2998/00* (2013.01)

(58) Field of Classification Search

CPC .. B22F 1/0059; B22F 1/0003; B22F 2998/00; C22C 38/02; C22C 33/0207

USPC ..... 419/46

See application file for complete search history.

(56) References Cited

U.S. PATENT DOCUMENTS

| | | | | |
|---|---|---|---|---|
| 3,375,105 | A * | 3/1968 | Lynch | 420/121 |
| 4,483,905 | A | 11/1984 | Engstrom | |
| 4,834,800 | A | 5/1989 | Semel | |
| 5,108,493 | A * | 4/1992 | Causton | 75/255 |
| 5,154,881 | A | 10/1992 | Rutz | |
| 5,217,683 | A | 6/1993 | Causton | |
| 5,290,336 | A | 3/1994 | Luk | |
| 5,298,055 | A | 3/1994 | Semel et al. | |
| 5,330,792 | A | 7/1994 | Johnson et al. | |
| 5,368,630 | A | 11/1994 | Luk | |
| 5,484,469 | A | 1/1996 | Rutz et al. | |
| 5,498,276 | A | 3/1996 | Luk | |
| 5,529,600 | A | 6/1996 | Fernandez | |
| 5,782,954 | A | 7/1998 | Luk | |
| 2009/0252636 | A1 | 10/2009 | Christopherson, Jr. | |

FOREIGN PATENT DOCUMENTS

| | | |
|---|---|---|
| WO | WO 2009/085000 | 7/2009 |
| WO | WO 2010/107372 | 9/2010 |

* cited by examiner

*Primary Examiner* — Weiping Zhu

(74) *Attorney, Agent, or Firm* — Baker & Hostetler LLP

(57) ABSTRACT

Iron-based metallurgical powders comprising vanadium are described, as well as compacted articles made thereof These articles have improved mechanical properties.

24 Claims, 8 Drawing Sheets

VANADIUM-CONTAINING POWDER METALLURGICAL POWDERS AND METHODS OF THEIR USE

CROSS REFERENCE TO RELATED APPLICATIONS

This application claims the benefit of U.S. Provisional Application No. 61/472,262, filed Apr. 6, 2011, the entirety of which is incorporated herein.

TECHNICAL FIELD

The invention relates to improved powder metallurgical compositions that include vanadium.

BACKGROUND

Powder metallurgical compositions are gaining increased use for making metal parts. As such, improved compositions that provide for sintered parts having increased strength, without negatively impacting the properties of the sintered part, are needed.

SUMMARY

The present invention is directed to metallurgical powder compositions comprising at least 90%, based on the weight of the metallurgical powder composition, of an iron-based metallurgical powder; and at least one additive that is a prealloy comprising vanadium; wherein the total vanadium content of the composition is about 0.05% to about 1.0% by weight of the composition. Methods of making these compositions and compacted articles prepared using these compositions are also described.

DETAILED DESCRIPTION OF ILLUSTRATIVE EMBODIMENTS

Figure 1:
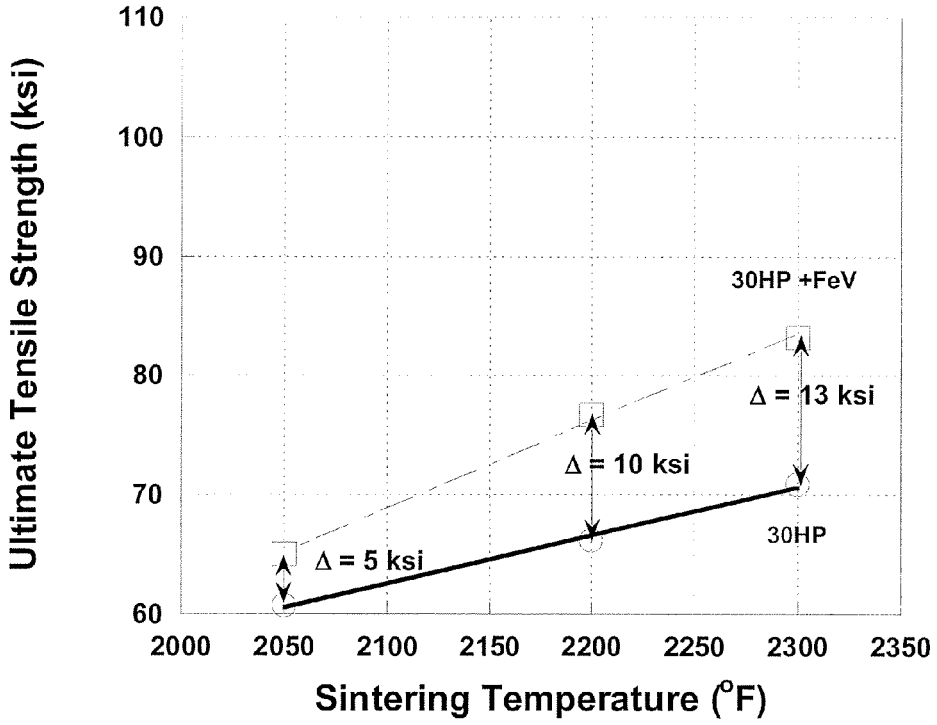
FIG. 1 depicts a comparison of ultimate tensile strength as a function of sintering temperature of an embodiment of the invention comprising ANCORSTEEL 30HP+0.7 wt. % graphite+Fe—V prealloy (80% vanadium).

Iron-based compositions that may include vanadium have been previously described in, for example, U.S. Pat. Nos. 5,782,954; 5,484,469; 5,217,683; 5,154,881; 5,108,493; and International Publications WO 10/107372 and WO 09/085000. However, it has now been discovered that when vanadium is incorporated into the compositions in the amounts and forms described herein, significant and unexpected improvements are imparted to the properties of metal parts prepared from such compositions.

More particularly, it has now been discovered that adding vanadium (V) to iron-based metallurgical powders in the amounts herein described, and most preferably in the form of a prealloy, improves the mechanical properties of the resulting compacted articles prepared using such iron-based powders. Within the scope of the invention, the iron-based metallurgical powder compositions comprise between about 0.05 wt. % to about 1.0 wt. %, based on the weight of the iron-based metallurgical powder composition, of vanadium. Some embodiments of the invention include between about 0.1 wt. % and about 0.5 wt. %, based on the weight of the metallurgical powder composition, of vanadium. Preferred embodiments of the invention include less than about 0.3 wt. %, based on the weight of the metallurgical powder composition, of vanadium. Exemplary embodiments of the invention include about 0.1 to about 0.2 wt. %, based on the weight of the metallurgical powder composition, of vanadium.

The vanadium can be added to iron-based powders to form the metallurgical powder compositions of the invention using any one or a combination of methods described herein. Vanadium can be added to iron-based powders in the form of at least one additive that is a prealloy comprising vanadium. As used herein, a "prealloy" additive of the invention is prepared by melting the constituents of the additive to form a homogeneous melt and then atomizing the melt, whereby the atomized droplets form the prealloyed additive upon solidification. Water-atomization is a preferred atomization technique for the production of prealloy additives of the invention, although other atomization techniques known in the art can also be used.

It is envisioned that the vanadium can be prealloyed with other metals contemplated for the metallurgical powder compositions of the invention. In some embodiments of the invention, the additive comprises vanadium and at least one or more of iron, chromium, nickel, silicon, manganese, copper, carbon, boron, and nitrogen. Preferably, the additive comprises vanadium and at least one or more of iron, chromium, nickel, silicon, manganese, copper, and carbon. In preferred embodiments of the invention, the additive is a prealloy comprising vanadium and iron (Fe). The additive may contain additional alloying elements that are intended for the final powder composition—that is, in common parlance, the additive can consist essentially of vanadium and iron—or the additive can be limited to vanadium and iron.

Additives that are prealloys consisting only of Fe and V can include up to about 99 wt. %, based on the weight of the prealloy, of vanadium, with the balance comprising iron. Those skilled in the art can readily determine the amount of vanadium in a prealloy to be added to iron-based powder in order to prepare the metallurgical powder compositions of the invention having the preselected amount of vanadium present in the total composition. Preferred embodiments of the Fe—V prealloy additive include up to about 85%, based on the weight of the Fe—V prealloy additive, of vanadium, with the balance comprising iron. Other embodiments of the Fe—V prealloy additive include about 75% to about 80%, based on the weight of the Fe—V prealloy additive, of vanadium, with the balance comprising iron. Still other embodiments of the invention, the Fe—V prealloy additive include about 78%-80%, based on the weight of the Fe—V prealloy additive, of vanadium.

The additive can also contain silicon in addition to iron and vanadium (Fe—V—Si). Other metals contemplated for the metallurgical powder compositions of the invention can be further included in the Fe—V—Si prealloy additives of the invention. Thus, in some embodiments, the additive may contain additional alloying elements that are intended for the final powder composition—that is, in common parlance, the additive can consist essentially of vanadium, iron, and silicon—or the additive can be limited to vanadium, iron, and silicon.

Fe—V—Si prealloy additives of the invention can include up to about 20%, based on the weight of the Fe—V—Si prealloy additive, of vanadium, with the balance being iron and silicon. Preferred Fe—V—Si prealloy additives of the invention can include up to about 15%, based on the weight of the Fe—V—Si prealloy additive, of vanadium, with the balance being iron and silicon. Fe—V—Si prealloy additives of the invention can include between about 3% to about 10.5%, based on the weight of the Fe—V—Si prealloy additive, of vanadium, with the balance being iron and silicon. In other embodiments, the Fe—V—Si prealloy additive can include between about 3% to about 7%, based on the weight of the prealloy additive, of vanadium. Other Fe—V—Si prealloy additives of the invention can include about 5%, based on the weight of the Fe—V—Si prealloy additive, of vanadium.

Some Fe—V—Si prealloy additives of the invention can include up to about 60%, based on the weight of the Fe—V—Si prealloy additive, of silicon. Some Fe—V—Si prealloy additives of the invention can include up to about 45%, based on the weight of the Fe—V—Si prealloy additive, of silicon. Some Fe—V—Si prealloy additives of the invention can include between about 17% and about 30%, based on the weight of the Fe—V—Si prealloy additive, of silicon. Some Fe—V—Si prealloy additives of the invention can include between about 17% and about 21%, based on the weight of the Fe—V—Si prealloy additive, of silicon. Other Fe—V—Si prealloy additives of the invention include about 19%, based on the weight of the Fe—V—Si prealloy additive, of silicon.

Other metallic elements contemplated by the invention can also be present in the Fe—V and Fe—V—Si prealloys described herein so long as the total vanadium content of the prealloy is as described herein.

The mean particle size (d50, measured using any techniques conventional in the art, including sieve analysis and laser diffraction) of the additives of the invention can be up to about 70 microns or up to about 60 microns. Particularly preferred additive embodiments include those additives having a d50 of less than or equal to about 20 microns, with about 20 microns being the preferred d50. In other embodiments, the d50 of the additive is less than or equal to about 15 microns. Other preferred embodiments include additives having a d50 of less than or equal to about 10 microns. Some embodiments include additives having a d50 of less than or equal to 5 microns. Yet other embodiments include additives having a d50 of about 2 microns.

Those skilled in the art can readily calculate the amount of the additive necessary to bring the total vanadium content of the metallurgical powder compositions of the invention to about 0.05% to about 1.0% by weight of the metallurgical powder composition. The additive is a minor component of the metallurgical powder compositions of the invention, typically present in amounts less than or equal to 20%, based on the weight of the metallurgical powder composition. For example, depending on the vanadium content of the additive, the metallurgical powder compositions of the invention can comprise about 0.2% to about 5%, based on the weight of the metallurgical powder composition, of the at least one additive. In other embodiments, the metallurgical powder compositions of the invention can comprise about 0.2% to about 3.5%, based on the weight of the metallurgical powder composition, of the at least one additive. Exemplary embodiments include about 3%, based on the weight of the metallurgical powder composition, of the at least one additive.

In addition to additives in the form of a prealloy as described above, vanadium can be incorporated into the metallurgical powder compositions of the invention through other forms of vanadium metal. An exemplary form of vanadium metal is vanadium pentoxide. Vanadium can also be incorporated into the composition in the form of diffusion alloyed vanadium, for example, diffusion alloyed with iron. It is also envisioned that vanadium can be deposited on the outside of an iron-based powder or deposited on the outside of a prealloy of iron and other metallic elements such as molybdenum, nickel, or a combination thereof.

The metallurgical powder compositions of the invention also comprise an iron-based powder. The iron-based powders of the invention are distinct from the prealloyed vanadium-containing additives described above and are not to be construed as being within the scope of the prealloyed additives described above. Metallurgical powder compositions of the invention comprise at least 80%, based on the weight of the metallurgical powder composition, of an iron-based powder. Preferably, the metallurgical powder compositions of the invention comprise at least 90%, based on the weight of the metallurgical powder composition, of an iron-based powder. In other embodiments, the metallurgical powder compositions of the invention comprise at least about 95%, based on the weight of the metallurgical powder composition, of an iron-based powder. It is envisioned that the mechanical properties of any article prepared from any known iron-based powder would benefit by the addition of vanadium to the iron-based powder, using the methods described herein. The remaining wt. % of the compositions, in addition to including the vanadium additives and/or prealloy additives described herein, can include binders, lubricants, other prealloys, etc. that are commonly employed in powder metallurgy.

Some embodiments of the invention use substantially pure iron powders containing not more than about 1.0% by weight, preferably no more than about 0.5% by weight, of normal impurities. Examples of such metallurgical-grade iron powders are the ANCORSTEEL 1000 series of pure iron powders, e.g. 1000, 1000B, and 1000C, available from Hoeganaes Corporation, Cinnaminson, N.J. ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other iron powders that are used in the invention are typical sponge iron powders, such as Hoeganaes' ANCOR MH-100 powder.

The iron-based powders of the invention can optionally incorporate one or more alloying elements that enhance mechanical, and other, properties of the final metal part. Such iron-based powders are powders of iron, preferably substantially pure iron, that have been pre-alloyed with one or more such elements. The pre-alloyed powders are prepared by making a substantially homogeneous melt of iron and the desired alloying elements, and then atomizing the melt, whereby the atomized droplets form the powder upon solidification. The melt blend is atomized using conventional atomization techniques, such as for example water atomization. In another embodiment, magnetic powders are prepared by first providing a metal-based powder, and then coating the powder with an alloying material.

Examples of alloying elements that are pre-alloyed with iron-based powders include, but are not limited to, molybdenum, manganese, magnesium, chromium, silicon, copper, nickel, columbium (niobium), graphite, phosphorus, titanium, aluminum, and combinations thereof. The amount of the alloying element or elements incorporated depends upon the properties desired in the final composition. Exemplary iron-based powders that can be used to prepare the metallurgical powder compositions of the invention include those available from Hoeganaes Corp, Cinnaminson, N.J., such as ANCORSTEEL 30HP, ANCORSTEEL 50HP, ANCORSTEEL 85HP, ANCORSTEEL 150HP, ANCORSTEEL 2000, ANCORSTEEL 4600V, ANCORSTEEL 721 SH, ANCORSTEEL 737 SH, ANCORSTEEL FD-4600, and ANCORSTEEL FD-4800A.

A further example of iron-based powders are diffusion-bonded iron-based powders which are particles of substantially pure iron that have a layer or coating of one or more other metals, such as steel-producing elements, diffused into their outer surfaces. Such commercially available powders that can be used to prepared the metallurgical powder compositions of the invention include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

In preferred embodiments of the invention, the iron-based metallurgical powder composition is essentially free of vanadium. That is, the vanadium is incorporated into the final composition solely through the additives described herein.

It is preferred that the metallurgical powder compositions of the invention include elements other than iron and vanadium, and where appropriate, silicon. Preferred elements include molybdenum, nickel, carbon (graphite), copper, and combinations thereof. These elements can be present in the metallurgical compositions of the invention in any form, as described above. For example, these elements can be present in the metallurgical compositions of the invention in either elemental form or, for example, oxide form. These elements can also be prealloyed with the iron-based powder compositions of the invention or brought into the composition by being included in the vanadium pre-alloy additive.

As described above, metallurgical powder compositions of the invention can include molybdenum. Preferably, metallurgical powder compositions of the invention include about 0.05% to about 2.0%, based on the weight of the metallurgical powder composition, of molybdenum. In other embodiments, the metallurgical powder compositions of the invention include about 0.05% to about 1.0%, based on the weight of the metallurgical powder composition, of molybdenum. Other embodiments of the invention include about 0.05% to about 0.35%, based on the weight of the metallurgical powder composition, of molybdenum. Preferred embodiments include about 0.25% to about 0.35%, based on the weight of the composition, of molybdenum. In other embodiments, the metallurgical powder compositions include about 0.3% to 1.5%, based on the weight of the composition, of molybdenum. In preferred embodiments, the metallurgical powder compositions include about 0.3% to 1.0%, based on the weight of the composition, of molybdenum. Particularly preferred embodiments include about 0.35%, about 0.55%, about 0.85%, or about 1.5%, based on the weight of the composition, of molybdenum.

As described above, preferred metallurgical powder compositions of the invention can include carbon, also referred to as graphite. Preferably, metallurgical powder compositions of the invention include 0.05% up to about 2.0%, based on the weight of the composition, of graphite. Some embodiments include 0.05 to about 1.5%, based on the weight of the composition, of graphite. Other embodiments include 0.05 to about 1.0%, based on the weight of the composition, of graphite. Still other embodiments include about 0.7%, based on the weight of the composition, of graphite.

As described above, preferred metallurgical powder compositions of the invention can include nickel. Preferably, metallurgical powder compositions of the invention include about 0.1% to about 2.0%, based on the weight of the composition, of nickel. Compositions include about 2.0%, based on the weight of the composition, of nickel. Other embodiments include about 0.2% to about 1.85%, based on the weight of the composition, of nickel. Some embodiments include about 0.25%, about 0.5%, about 1.4%, or about 1.8%, based on the weight of the composition, of nickel.

As described above, other preferred metallurgical powder compositions of the invention can include copper. Preferably, metallurgical powder compositions of the invention include up to about 3.0%, based on the weight of the composition, of copper. Particularly preferred are compositions including about 2.0%, based on the weight of the composition, of copper.

Metallurgical powder compositions of the invention can also include lubricants, whose presence reduces the ejection forces required to remove the compacted component form the compaction die cavity. Examples of such lubricants include stearate compounds, such as lithium, zinc, manganese, and calcium stearates, waxes such as ethylene bis-stearamides, polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., each of which is incorporated herein in its entirety by reference.

Metallurgical powder compositions of the invention can also include binders, particularly when the iron-based powder contains alloying elements in separate powder form. Binding agents that can be used in the present invention are those commonly employed by the powder metallurgy industry. For example, such binding agents include those found in U.S. Pat. No. 4,834,800 to Semel, U.S. Pat. No. 4,483,905 to Engstrom, U.S. Pat. No. 5,298,055 to Semel et. al., and U.S. Pat. No. 5,368,630 to Luk, the disclosures of which are each hereby incorporated by reference in their entireties.

The amount of binding agent present in the metallurgical powder composition depends on such factors as the density, particle size distribution and amounts of the elemental alloy powder and the base the iron powder in the metallurgical powder composition. Generally, the binding agent will be added in an amount of at least about 0.005 weight percent, more preferably from about 0.005 weight percent to about 1.0 weight percent, and most preferably from about 0.05 weight percent to about 0.5 weight percent, based on the total weight of the metallurgical powder composition.

Binding agents include, for example, polyglycols such as polyethylene glycol or polypropylene glycol; glycerin; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions, e.g., the binders described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 Patent to Luk can also act advantageously as a combination of binder and lubricant. Additional useful binding agents include the cellulose ester resins, hydroxy alkylcellulose resins, and thermoplastic phenolic resins, e.g., the binders described in U.S. Pat. No. 5,368,630 to Luk.

The metallurgical powder compositions of the invention can be compacted, sintered, and/or heat treated according to methods known in the art. For example, the metallurgical powder composition is placed in a compaction die cavity and compacted under pressure, such as between about 5 and about 200 tons per square inch (tsi), more commonly between about 10 and 100 tsi, and even more commonly between about 30 and 60 tsi. The compacted part is then ejected from the die cavity. The die may be used at ambient temperature or optionally cooled below room temperature or heated above room temperature. The die may be heated to greater than about 100° F., for example to greater than about 120° F. or as much as 270° F., such as, for example from about 150° F. to about 500° F.

While not wishing to be bound to any particular theory, it is believed that the increase strength observed in compacted, sintered, heat-treated articles of the invention is due to the refined grain size. The refined grain size is also believed to provide better impact properties at these higher strengths. Due to finer grain size, the ductility and impact strength of embodiments of the invention containing vanadium are higher than comparative materials not including vanadium, despite having higher strength.

Example—Preparation of an Fe—V—Si Prealloy

Ferro-vanadium (80% vanadium balance iron, "Fe—V") and 75% Ferro-Silicon ("Fe—Si") are melted with iron in an induction furnace to a nominal composition of 19% silicon-5% vanadium-balance iron. The liquid metal is then atomized with water using high pressure water atomization to form a powder that has a mean particle size of (d50) between about 25 and about 40 microns. The powder is dewatered and dried and then is either ground or screened so that the final particle size is about 10 to about 20 microns. The oxygen content of the additive is typically below about 0.50%.

Example—Effect of Vanadium Addition to Molybdenum-containing Iron-based Powders

Mix 1: 98.6 wt. % ANCORSTEEL 30HP, 0.7 wt. % graphite, 0.7wt. % ACRAWAX C (Lonza Inc., Allendale, N.J.)

Mix 2: 98.4 wt. % ANCORSTEEL 30HP, 0.7 wt. % graphite, 0.7wt. % ACRAWAX C, 0.2 wt. % Fe—V prealloy (80% vanadium, Hengyuan Metal % Alloy Powders Ltd., Oakville, ON L6L 1R4, Canada)

Mix 3: 95.1 wt. % ANCORSTEEL 30HP, 0.7 wt. % graphite, 0.7wt. % ACRAWAX C, 3.5 wt. % F—V—Si prealloy (5% vanadium, 19% silicon, d50=about 17 microns)

*ANCORSTEEL 30 HP (Hoeganaes Corp., Cinnaminson, N.J.) is typical of an iron-based powder that comprises about 0.30 wt. % to about 0.4 wt. % of molybdenum, and about 0.10 wt. % to about 0.2 wt. % of manganese.

Each of the above mixes was prepared and compacted (50 tsi) according to industry standards. The compacts were then sintered at about 2300° F. and the mechanical properties of the resulting sintered parts were tested. The results of those tests are depicted in Table 1. As can be seen from Table 1, the addition of vanadium results in a significant increase in the as-sintered mechanical properties. "Ksi," in Table 1 and throughout the specification, examples, tables, and figures, refers to psi×$10^3$.

TABLE 1

| Sample | 0.2% YS (ksi) | UTS (ksi) | Elong (%) | Hardness (HRA) | Sint. D ($g/cm^3$) | Hardness (HRA) | Impact (ft * lbs) | Sint. D ($g/cm^3$) | TRS (ksi) | DC (%) | Hardness (HRA) |
|---|---|---|---|---|---|---|---|---|---|---|---|
| Mix 1 | 51.0 | 71.7 | 3.82 | 46 | 7.13 | 46 | 15 | 7.18 | 145.8 | 0.06 | 48 |
| Mix 2 | 64.0 | 83.2 | 3.00 | 48 | 7.11 | 49 | 12 | 7.15 | 167.0 | 0.09 | 51 |
| Mix 3 | 89.0 | 107.1 | 1.77 | 57 | 7.07 | 58 | 12 | 7.11 | 202.9 | 0.07 | 59 |

The sintered compacts prepared above were heat treated at 1650° F. for 1 hour, followed by an oil quench at 400° F. The mechanical properties of the resulting heat treated article were tested. The results of those tests are depicted in Table 2. As can be seen from Table 2, the addition of vanadium results in a significant increase in the heat treated mechanical properties.

TABLE 2

| Sample | 0.2% YS (ksi) | UTS (ksi) | Elong (%) | Hardness (HRA) | Sint. D ($g/cm^3$) | Hardness (HRA) | Impact (ft * lbs) | Sint. D ($g/cm^3$) | TRS (ksi) | DC (%) | Hardness (HRA) |
|---|---|---|---|---|---|---|---|---|---|---|---|
| Mix 1 | 115.5 | 147.2 | 0.89 | 71 | 7.12 | 72 | 8 | 7.16 | 228.9 | 0.03 | 71 |
| Mix 2 | 142.1 | 163.5 | 1.11 | 71 | 7.11 | 71 | 10 | 7.13 | 249.3 | 0.23 | 72 |
| Mix 3 | 134.0 | 163.7 | 1.11 | 72 | 7.04 | 72 | 10 | 7.09 | 263.1 | 0.16 | 74 |

Figure 2:
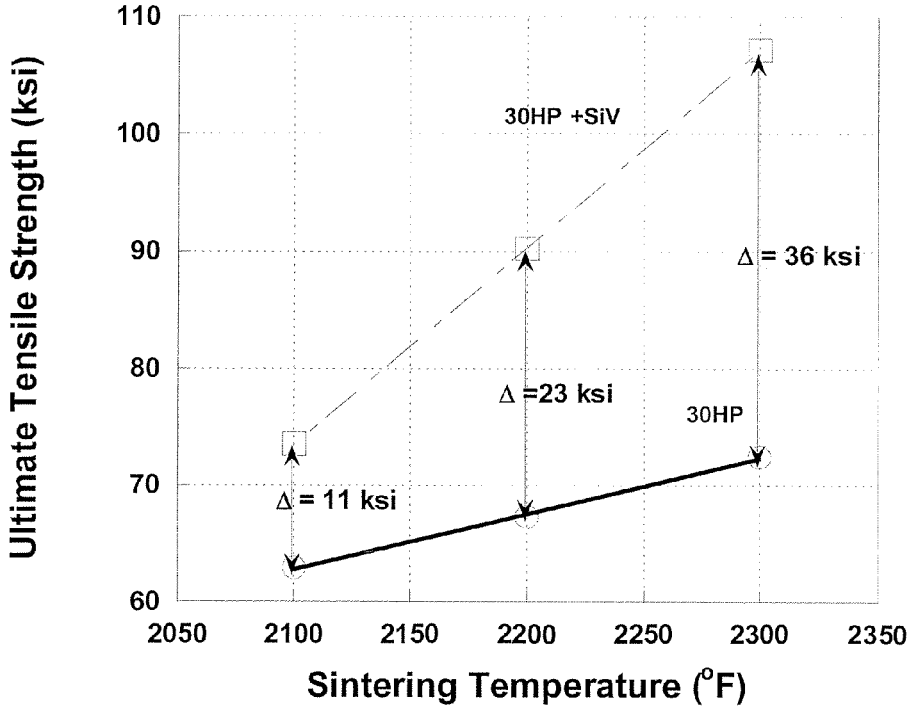
FIG. 2 depicts a comparison of ultimate tensile strength as a function of sintering temperature of an embodiment of the invention comprising ANCORSTEEL 30HP+0.7 wt. % graphite+Fe—V—Si prealloy (5% vanadium,19% silicon)

FIGS. 1 and 2 show the effect of an Fe—V prealloy and an Fe—Si—V prealloy on the ultimate tensile strength of ANCORSTEEL 30HP+0.70 wt. % graphite as a function of sintering temperature. As depicted in FIGS. 1 and 2, the properties increase with increasing sintering temperature. The sintering temperature was 2300° F.

Figure 3:
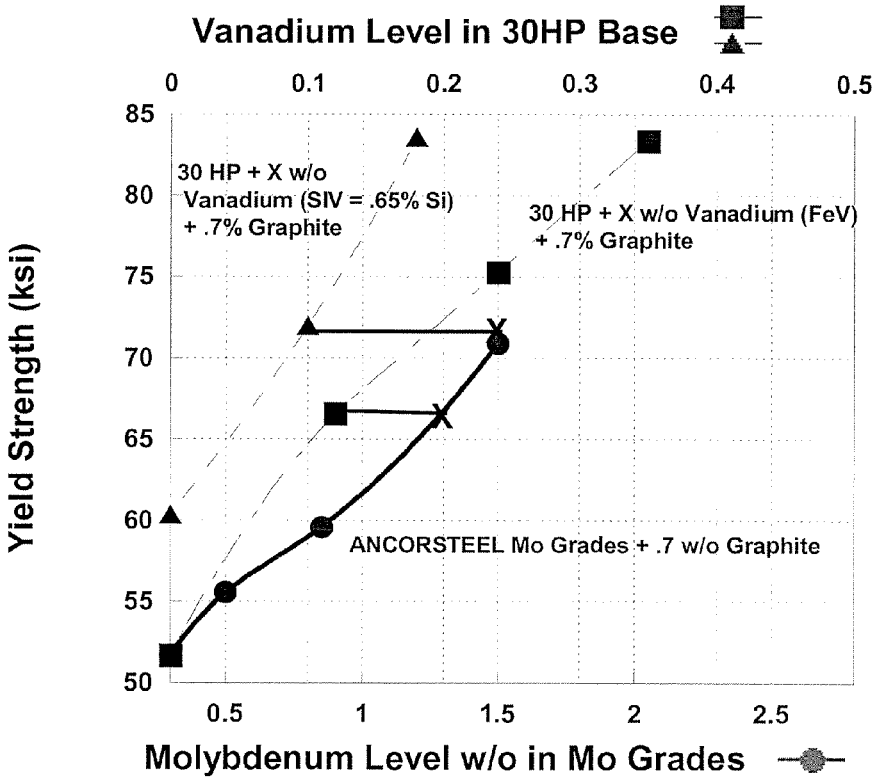
FIG. 3 depicts a comparison of sintered yield strength in embodiments comprising (▲) ANCORSTEEL 30 HP+Fe—V—Si prealloy (varying amounts of V depicted along top x axis)+0.7 wt. % graphite; (■) ANCORSTEEL 30 HP+Fe—V prealloy (varying amounts of V depicted along top x axis)+0.7 wt. % graphite; and (●) ANCORSTEEL HP (varying amounts of Mo depicted along bottom x axis)+0.7 wt. % graphite

FIG. 3 demonstrates that the sintered yield strength of embodiments of the invention is increased as a function of vanadium level. The tie lines between the 30HP+FeV curve and the ANCORSTEEL molybdenum grades indicate that the 0.16% vanadium addition to 30HP has a yield strength equivalent to approximately 1.3 w/o molybdenum. Similarly, the 30HP+Fe—Si—V yield strength (nominally 0.30 w/o Mo-0.60 wt. % Si and 0.08 wt. % vanadium) is equivalent to the yield strength of ANCORSTEEL 150HP. A 3.5 wt. % addition of the Fe—Si—V addition to 30HP (nominally 0.30 wt. % Mo-0.60 wt. % Si and 0.16 wt. % vanadium) leads to a superior yield strength than ANCORSTEEL 150HP (84 ksi versus 71 ksi) in the sintered condition.

Example—Effect of Vanadium Addition to Nickel-containing Iron-based Powders

Mix 4: 97.3 wt. % ANCORSTEEL 1000B, 0.7 wt. % graphite, 0.7 wt. % ACRAWAX C, 2.0 wt. % nickel Mix 5: 97.1 wt. % ANCORSTEEL 1000B, 0.7 wt. % graphite, 0.7 wt. % ACRAWAX C, 2.0 wt. % nickel, 0.2% Fe—V prealloy (80% vanadium)

Mix 6: 93.8 wt. % ANCORSTEEL 1000B, 0.7 wt. % graphite, 0.7 wt. % ACRAWAX C, 2.0 wt. % nickel, 3.5 wt. % Fe—V—Si prealloy (5% vanadium, 19% silicon, d50 = about 17 microns)

ANCORSTEEL 1000B (Hoeganaes Corp., Cinnaminson, N.J.)

Each of the above mixes was prepared and compacted (50 tsi) according to industry standards. The compacts were then sintered at about 2300° F. and the mechanical properties of the resulting sintered parts were tested. The results of those tests are depicted in Table 3. As can be seen from the Table, there was an increase in both the sintered strength and hardness in those embodiments including vanadium.

TABLE 3

| Sample | 0.2% YS (ksi) | UTS (ksi) | Elong (%) | Hardness (HRA) | Sint. D (g/cm$^3$) | Hardness (HRA) | Impact (ft * lbs) | Sint. D (g/cm$^3$) | TRS (ksi) | DC (%) | Hardness (HRA) |
|---|---|---|---|---|---|---|---|---|---|---|---|
| Mix 4 | 46.6 | 80.0 | 4.24 | 48 | 7.18 | 46 | 20 | 7.23 | 162.7 | −0.08 | 49 |
| Mix 5 | 64.3 | 93.9 | 3.83 | 51 | 7.16 | 53 | 16 | 7.21 | 185.6 | −0.02 | 53 |
| Mix 6 | 80.2 | 108.5 | 2.56 | 57 | 7.10 | 58 | 16 | 7.14 | 213.2 | −0.05 | 59 |

The sintered compacts prepared above were heat treated at 1650° F. for 1 hour, followed by an oil quench at 400° F. The mechanical properties of the resulting heat treated article were tested. The results of those tests are depicted in Table 4. As can be seen from the Table, there was an increase in both the strength and hardness, accompanied by an increase in the ductility and impact energy in those embodiments including vanadium.

TABLE 4

| Sample | 0.2% YS (ksi) | UTS (ksi) | Elong (%) | Hardness (HRA) | Sint. D (g/cm$^3$) | Hardness (HRA) | Impact (ft * lbs) | Sint. D (g/cm$^3$) | TRS (ksi) | DC (%) | Hardness (HRA) |
|---|---|---|---|---|---|---|---|---|---|---|---|
| Mix 4 | 108.2 | 132.8 | 0.81 | 72 | 7.18 | 71 | 11 | 7.22 | 208.1 | −0.08 | 73 |
| Mix 5 | 108.0 | 140.1 | 0.87 | 71 | 7.16 | 72 | 12 | 7.21 | 260.2 | 0.04 | 73 |
| Mix 6 | 156.6 | 165.7 | 1.11 | 72 | 7.10 | 73 | 13 | 7.13 | 274.8 | −0.2 | 74 |

Figure 4:
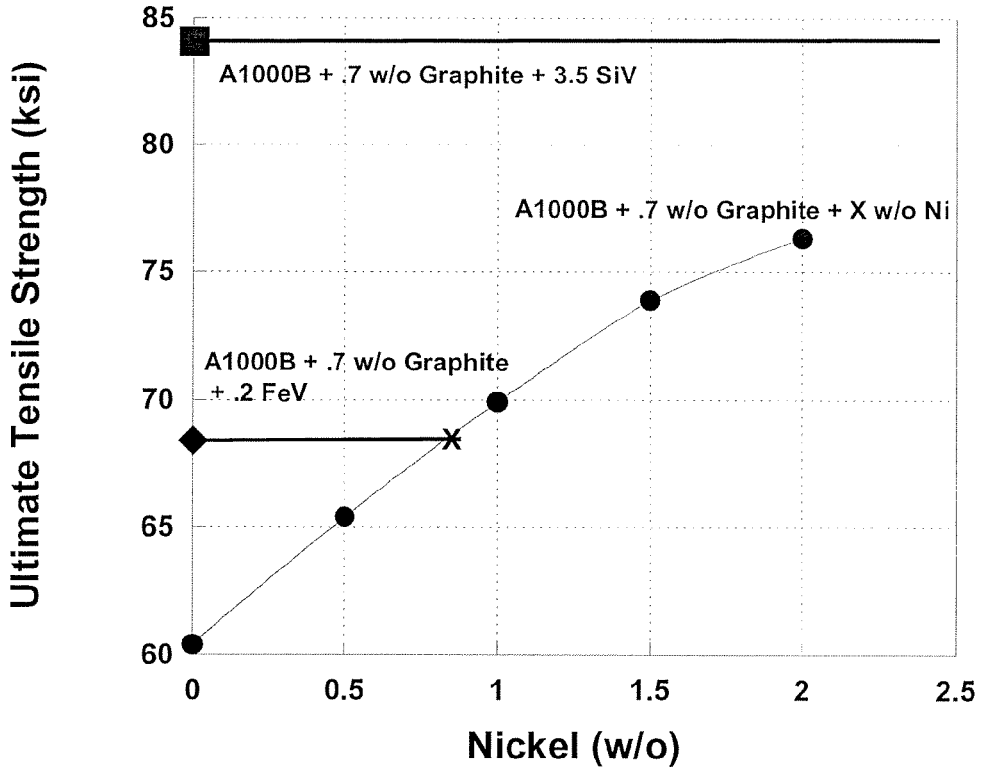
FIG. 4 depicts a comparison of heated-treated ultimate tensile strength embodiments comprising varying amounts of nickel and (■)ANCORSTEEL 1000B+0.7 wt. % graphite+3.5 wt. % Fe—V—Si prealloy (5% vanadium, 19% silicon); (♦)ANCORSTEEL 1000B+0.7 wt. % graphite+0.2 wt. % Fe—V prelloy (80% vanadium); and (●) ANCORSTEEL 1000B+0.7 wt. % graphite

FIG. 4 shows the heat treated ultimate tensile strength versus nickel content in embodiments of the invention versus ANCORSTEEL 1000B with Fe—V and Fe—Si—V prealloy additives, both of which are essentially free of nickel. As can be seen from FIG. 4, the Fe—V prealloy addition is equivalent to an addition of about 0.8 wt. % nickel while the Fe—Si—V prealloy addition gives a heat treated UTS that exceeds that of 2 wt. % nickel.

Example—Effect of Vanadium Addition to Carbon-containing Iron-based Powders

Mix 7: 98.6 wt. % ANCORSTEEL 1000B, 0.7 wt. % graphite, 0.7 wt. % ACRAWAX C

Mix 8: 98.4 wt. % ANCORSTEEL 1000B, 0.7 wt. % graphite, 0.7 wt. % ACRAWAX C, 0.2 wt. % Fe—V prealloy (80% vanadium)

Mix 9: 95.1 wt. % ANCORSTEEL 1000B, 0.7 wt. % graphite, 0.7 wt. % ACRAWAX C, 3.5 wt. % Fe—V—Si prealloy (5% vanadium, 19% silicon, about 17 microns)

Each of the above mixes was prepared and compacted (50 tsi) according to industry standards. The compacts were then sintered at about 2300° F. and the mechanical properties of the resulting sintered parts were tested. The results of those tests are depicted in Table 5. As can be seen from the Table, the addition of vanadium resulted in increased strength and hardness.

TABLE 5

| Sample | 0.2% YS (ksi) | UTS (ksi) | Elong (%) | Hardness (HRA) | Sint. D (g/cm$^3$) | Hardness (HRA) | Impact (ft * lbs) | Sint. D (g/cm$^3$) | TRS (ksi) | DC (%) | Hardenss (HRA) |
|---|---|---|---|---|---|---|---|---|---|---|---|
| Mix 7 | 38.2 | 60.4 | 4.80 | 41 | 7.13 | 41 | 16 | 7.17 | 124.9 | 0.14 | 42 |
| Mix 8 | 53.8 | 72.1 | 3.40 | 47 | 7.11 | 47 | 12 | 7.15 | 140.3 | 0.18 | 48 |
| Mix 9 | 63.2 | 85.1 | 2.93 | 52 | 7.05 | 52 | 13 | 7.10 | 173.9 | 0.14 | 54 |

The sintered compacts prepared above were heat treated at 1650° F. for 1 hour, followed by an oil quench at 400° F. The mechanical properties of the resulting heat treated article were tested. The results of those tests are depicted in Table 6.

TABLE 6

| Sample | 0.2% YS (ksi) | UTS (ksi) | Elong (%) | Hardness (HRA) | Sint. D (g/cm$^3$) | Hardness (HRA) | Impact (ft * lbs) | Sint. D (g/cm$^3$) | TRS (ksi) | DC (%) | Hardness (HRA) |
|---|---|---|---|---|---|---|---|---|---|---|---|
| Mix 7 | 121.0 | 138.7 | 0.87 | 73 | 7.13 | 71 | 8 | 7.17 | 207.6 | 0.17 | 73 |
| Mix 8 | 109.3 | 120.0 | 1.15 | 65 | 7.12 | 66 | 10 | 7.15 | 210.6 | 0.27 | 68 |
| Mix 9 | 125.0 | 146.7 | 0.86 | 71 | 7.06 | 72 | 10 | 7.10 | 228.1 | 0.24 | 72 |

Figure 5:
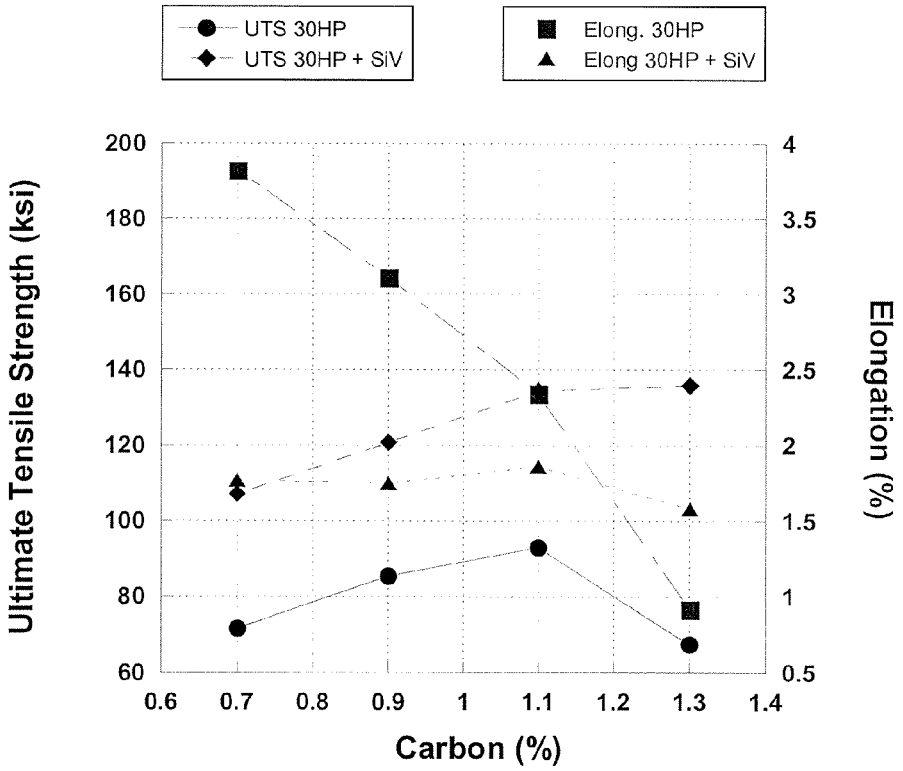
FIG. 5 depicts a comparison of ultimate tensile strength and elongation of varying amounts of carbon with ANCORSTEEL 30 HP versus ANCORSTEEL 30 HP+Fe—V—Si prealloy, an embodiment of the invention

FIG. 5 shows a comparison of the ultimate tensile strength (heat treated) of ANCORSTEEL 30HP and ANCORSTEEL 30HP with Fe—Si—V prealloy additive versus carbon level. As can be seen from FIG. 5, the ductility of the ANCORSTEEL 30HP with no additive continuously decreases with carbon content. The ultimate tensile strength starts to decrease above about 1.1 wt. % carbon. When the Fe—Si—V prealloy is added, the tensile elongation holds relatively constant while the UTS strength continues to increase above 1.1 wt. % carbon.

Example—Effect of Vanadium Addition to Copper-containing Iron-based Powders

Mix 10: 96.6 wt. % ANCORSTEEL 1000B, 0.7 wt. % graphite, 0.7 wt. % ACRAWAX C, 2.0 wt. % copper Mix 11: 96.4 wt. % ANCORSTEEL 1000B, 0.7 wt. % graphite, 0.7 wt. % ACRAWAX C, 2.0 wt. % copper, 0.2 wt. % Fe—V prealloy (80% vanadium)

Mix 12: 93.1 wt. % ANCORSTEEL 1000B, 0.7 wt. % graphite, 0.7 wt. % ACRAWAX C, 2.0 wt. % copper, 3.5 wt. % Fe—V—Si prealloy (5% vanadium, 19% silicon, about 17 microns)

Each of the above mixes was prepared and compacted (50 tsi) according to industry standards. The compacts were then sintered at about 2300° F. and the mechanical properties of the resulting sintered parts were tested. The results of those tests are depicted in Table 7.

TABLE 7

| Sample | 0.2% YS (ksi) | UTS (ksi) | Elong (%) | Hardness (HRA) | Sint. D (g/cm$^3$) | TRS (ksi) | DC (%) | Hardness (HRA) | Sint. D (g/cm$^3$) | Hardness (HRA) | Impact (ft * lbs) |
|---|---|---|---|---|---|---|---|---|---|---|---|
| Mix 10 | 70.6 | 92.9 | 2.66 | 52 | 7.12 | 190.9 | 0.33 | 54 | 7.07 | 53 | 14 |
| Mix 11 | 73.5 | 91.5 | 2.35 | 53 | 7.10 | 183.4 | 0.39 | 54 | 7.05 | 53 | 12 |
| Mix 12 | 80.6 | 96.3 | 1.58 | 55 | 6.99 | 185.3 | 0.54 | 55 | 6.97 | 55 | 10 |

The sintered compacts prepared above were heat treated at 1650° F. for 1 hour, followed by an oil quench at 400° F. The mechanical properties of the resulting heat treated article were tested. The results of those tests are depicted in Table 8.

TABLE 8

| Sample | 0.2% YS (ksi) | UTS (ksi) | Elong (%) | Hardness (HRA) | Sint. D (g/cm$^3$) | TRS (ksi) | DC (%) | Hardness (HRA) | Sint. D (g/cm$^3$) | Hardness (HRA) | Impact (ft * lbs) |
|---|---|---|---|---|---|---|---|---|---|---|---|
| Mix 10 | 98.1 | 122.2 | 0.67 | 70 | 7.11 | 212.6 | 0.36 | 71 | 7.07 | 71 | 9 |
| Mix 11 | 120.8 | 138.8 | 0.85 | 71 | 7.09 | 227.1 | 0.47 | 71 | 7.05 | 70 | 8 |
| Mix 12 | 140.9 | 153.5 | 0.91 | 71 | 6.99 | 226.8 | 0.57 | 71 | 6.96 | 72 | 8 |

Example—Hardenability

A hardenability study was conducted in which a standard inclusion slug was austenitized at 1650° F. and oil quenched according to procedures known in the art. Micro indentation hardness readings were taken through the thickness of the inclusion slug to simulate a jominy hardenability test. The results of these measurements are shown in FIG. 6.

Figure 6:
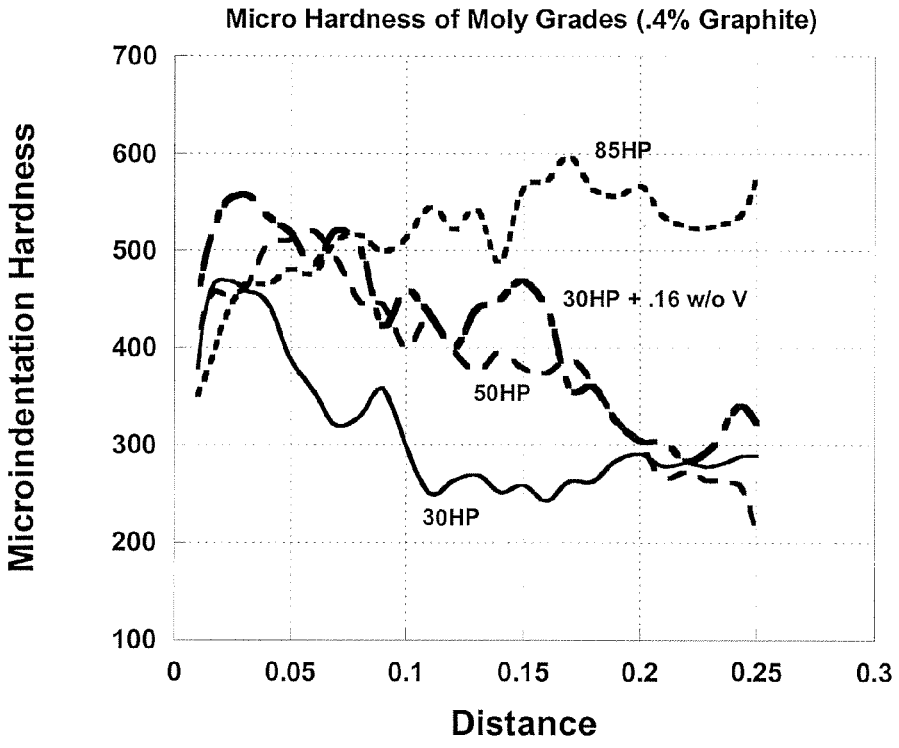
FIG. 6 depicts hardenability of ANCORSTEEL 30HP, 50HP, and 85HP compared to ANCORSTEEL 30HP+0.16 wt. % vanadium, an embodiment of the invention

In FIG. 6, the hardenability of various ANCORSTEEL Mo grades (30HP, 50HP and 85HP, each with 0.4 wt. % graphite) were compared to an ANCORSTEEL 30HP with 0.16 wt. % vanadium (added via a Fe—V prealloy). As demonstrated in FIG. 6, the hardenability of ANCORSTEEL 30HP with vanadium exceeds that of ANCORSTEEL 30HP. Moreover, the ANCORSTEEL 30HP with vanadium is equivalent to, or better than, ANCORSTEEL 50HP. The ANCORSTEEL 85HP with 0.4 wt. % graphite thru hardened to a depth of 0.25 inches.

Example—Metallographic Results

Figure 7A:
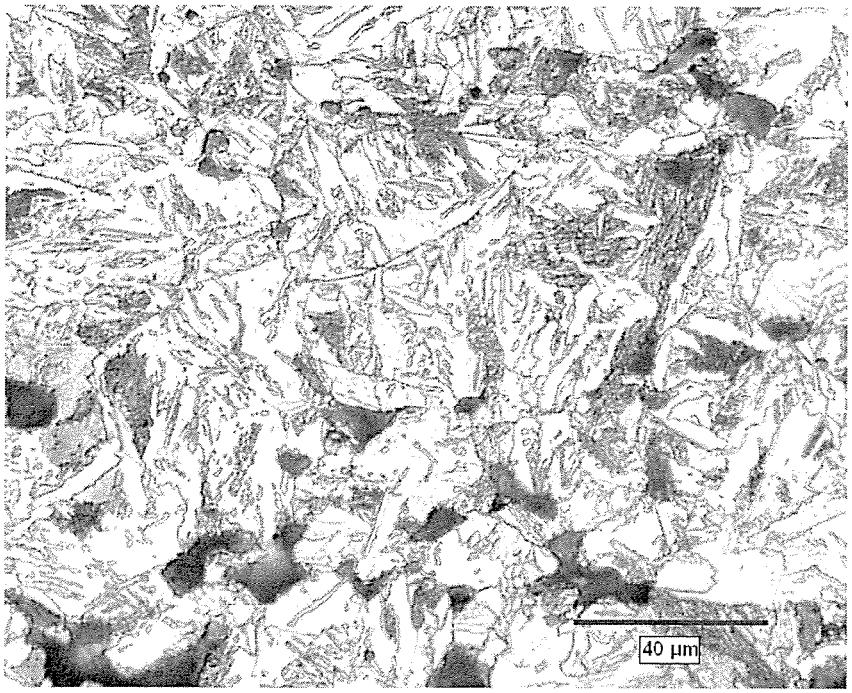
FIG. 7A depicts the microstructure of Fe+0.3 wt. % Mo+0.65% carbon (as-sintered)
Figure 7B:
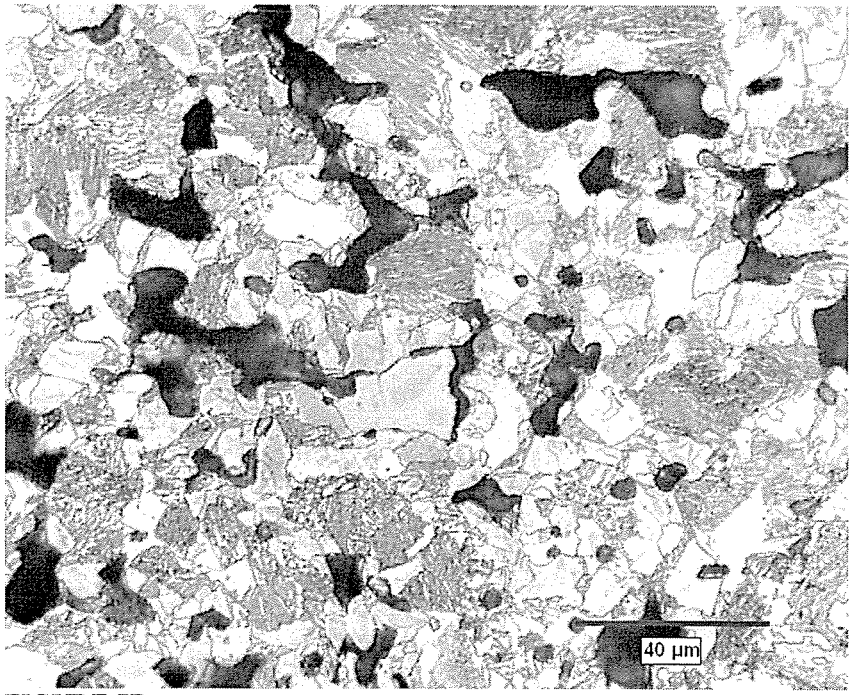
FIG. 7B depicts the microstructure of Fe+0.3 wt. % Mo+0.3 wt. % vanadium+0.65% carbon (as-sintered), an embodiment of the invention

Metallographic results of the Fe—V prealloy additive in sintered ANCORSTEEL 30HP are shown in FIGS. 7A and 7B. As can be seen from FIGS. 7A and 7B, the addition of the vanadium results in a more lamellar pearlitic structure. The spacing of the pearlite is also finer with the addition of vanadium. Both these factors are believed to contribute to the increase in strength in the as-sintered condition.

Example—Grain Size

Figure 8A:
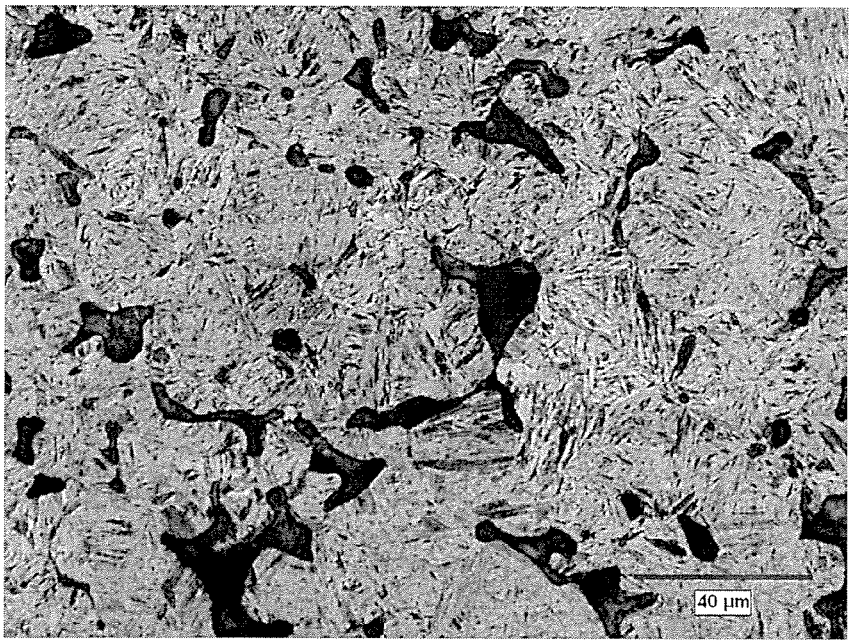
FIG. 8A depicts grain size of Fe-0.3 wt. % Mo-0.7 wt. % graphite (heat treated), an embodiment of the invention
Figure 8B:
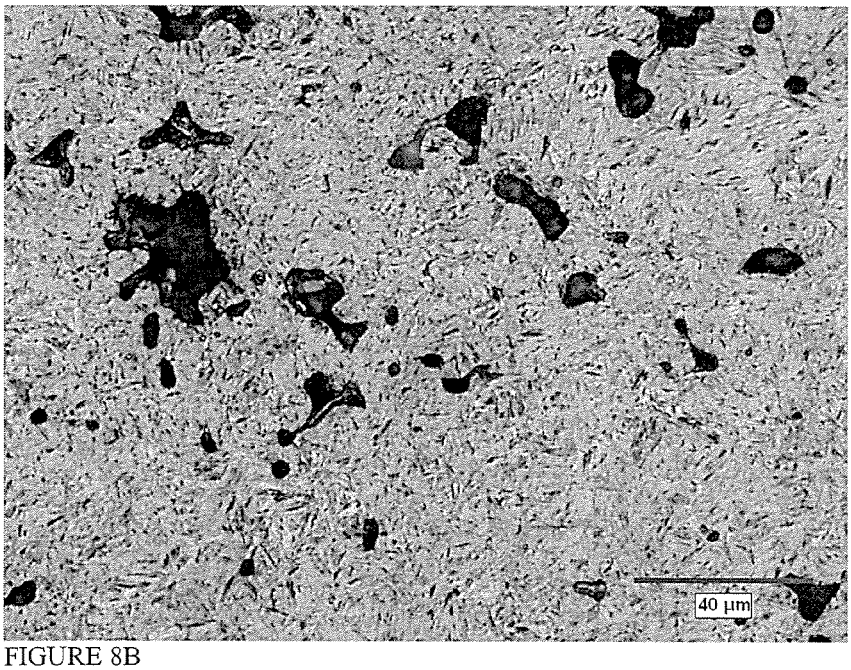
FIG. 8B depicts grain size of Fe-0.3 wt. % Mo-0.7 wt. % graphite 0.14 wt. % V (heat treated), an embodiment of the invention

FIGS. 8A and 8B show the martensite needles in the heat treated condition are much finer in the material with vanadium (added via Fe—V prealloy), indicating a finer austenite grain size prior to quenching. The finer grain size is believed to lead to higher ultimate tensile strengths with better ductility and impact energy, as demonstrated in the foregoing examples.

What is claimed:

1. A metallurgical powder composition comprising:

from 90% to 99%, based on the weight of the metallurgical powder composition, of an iron-based metallurgical powder; and at least one additive that is a prealloy comprising iron, silicon, and vanadium; wherein the additive comprises about 3% to about 10.5%, based on the weight of the additive, of vanadium, and about 17% to about 30%, based on the weight of the additive, of silicon;

wherein the total vanadium content of the composition is about 0.05% to about 1.0% by weight of the composition.

2. The metallurgical powder composition of claim 1, wherein the additive further comprises at least one or more of chromium, nickel, manganese, copper, carbon, boron, and nitrogen.

3. The metallurgical powder composition of claim 1, wherein the additive comprises about 3% to about 7%, based on the weight of the additive, of vanadium, and about 17% to about 21%, based on the weight of the additive, of silicon.

4. The metallurgical powder composition of claim 1, wherein the additive comprises less than about 0.50%, based on the weight of the additive, of oxygen.

5. The metallurgical powder composition of claim 1, wherein the metallurgical powder composition comprises about 0.2% to about 5%, based on the weight of the metallurgical powder composition, of the additive.

6. The metallurgical powder composition of claim 5, wherein the metallurgical powder composition comprises about 3.5%, based on the weight of the metallurgical powder composition, of the additive.

7. The metallurgical powder composition of claim 1, wherein the additive has a mean particle size (d50) of about 10 to 20 microns.

8. The metallurgical powder composition of claim 1, wherein the metallurgical powder composition further comprises from about 0.05 weight % to about 2.0 weight % molybdenum, from about 0.1 weight % to about 2.0 weight % nickel, from about 0.05 weight % to about 2.0 weight % graphite, up to about 3.0 weight % copper, or a combination thereof.

9. The metallurgical powder composition of claim 8, wherein the metallurgical powder composition comprises about 0.05% to about 2.0%, based on the weight of the metallurgical powder composition, of molybdenum.

10. The metallurgical powder composition of claim 9, wherein the metallurgical powder composition comprises about 0.05% to about 1%, based on the weight of the metallurgical powder composition, of molybdenum.

11. The metallurgical powder composition of claim 10, wherein the metallurgical powder composition comprises about 0.05% to about 0.35%, based on the weight of the metallurgical powder composition, of molybdenum.

12. The metallurgical powder composition of claim 11, wherein the metallurgical powder composition comprises about 0.25% to about 0.35%, based on the weight of the metallurgical powder composition, of molybdenum.

13. The metallurgical powder composition of claim 8, wherein the metallurgical powder composition comprises about 0.1% to about 2.0%, based on the weight of the metallurgical powder composition, of nickel.

14. The metallurgical powder composition of claim 8, wherein the metallurgical powder composition comprises about 0.05% to about 2.0%, based on the weight of the metallurgical powder composition, of graphite.

15. The metallurgical powder composition claim 14, wherein the metallurgical powder composition comprises about 0.7%, based on the weight of the metallurgical powder composition, of graphite.

16. The metallurgical powder composition of claim 8, wherein the metallurgical powder composition comprises up to about 3.0%, based on the weight of the metallurgical powder composition, of copper.

17. The metallurgical powder composition of claim 16, wherein the metallurgical powder composition comprises about 2.0%, based on the weight of the metallurgical powder composition, of copper.

18. The metallurgical powder composition of claim 1, wherein the iron-based metallurgical powder composition is a prealloy.

19. The metallurgical powder composition of claim 1, wherein the iron-based metallurgical powder composition is essentially free of vanadium.

20. The metallurgical powder composition of claim 1, wherein the total vanadium content of the metallurgical powder composition is provided by the at least one additive.

21. The metallurgical powder composition of claim 1, further comprising a lubricant.

22. The metallurgical powder composition of claim 1, further comprising a binder.

23. A compacted part comprising the metallurgical powder composition of claim 1.

24. The compacted part of claim 23, wherein the part is sintered.

* * * * *